US005622062A

United States Patent [19]

Gong-Hwa

[11] Patent Number: 5,622,062

[45] Date of Patent: Apr. 22, 1997

[54] RING WITH SOUND AND LIGHT PRODUCING MEANS

[75] Inventor: Lin Gong-Hwa, Chung Ho, Taiwan

[73] Assignee: Cute Item Enterprise Co., Ltd., Taipei Hsien, Taiwan

[21] Appl. No.: 640,402

[22] Filed: Apr. 30, 1996

[51] Int. Cl.[6] ..... A44C 9/00

[52] U.S. Cl. ..... 63/15; 63/1.13

[58] Field of Search ..... 63/2, 15, 15.1, 63/15.2, 15.45, 15.7, 26, 27, DIG. 3

[56] References Cited

U.S. PATENT DOCUMENTS

| | | | |
|---|---|---|---|
| 2,584,087 | 1/1952 | Barbieri | 63/2 X |
| 3,392,276 | 7/1968 | Roman | 63/15 X |
| 4,009,381 | 2/1977 | Schreiber et al. | 63/2 X |
| 4,093,973 | 6/1978 | Vaagenes | 63/15 X |

FOREIGN PATENT DOCUMENTS

| | | | |
|---|---|---|---|
| 2036537 | 7/1980 | United Kingdom | 63/2 |

*Primary Examiner*—Kien T. Nguyen
*Attorney, Agent, or Firm*—Pro-Techtor International

[57] ABSTRACT

A ring which includes a ring base having a top open chamber and a plurality of bottom through holes and a circular bottom band, a cap loosely coupled to the ring base, and a circuit device mounted inside the top open chamber of the ring base, the circuit device including a sound producing circuit, a light producing circuit, a battery power supply circuit, and a switch, the switch being switched on to trigger the sound producing circuit and the light producing circuit to produce sound and light for a predetermined length of time each time when the cap is depressed.

4 Claims, 4 Drawing Sheets

RING WITH SOUND AND LIGHT PRODUCING MEANS

BACKGROUND OF THE INVENTION

The present invention relates to rings, and relates more particularly to such a ring which produces sound and lighting effects for a predetermined length of time when depressed.

Different rings may be worn on the fingers for decoration or for different meanings. For example, a wedding ring is adapted for use in a wedding and an engagement ring is adapted for giving a promise to marry. Regular rings commonly comprise a circular band made from precious metal such as fold, platinum, etc., for fastening to one's finger. A collet may be made on the circular band to hold a gemstone. Conventional rings attract people to buy by means of its particular design. However, few young children can afford to buy expensive rings.

SUMMARY OF THE INVENTION

It is one object of the present invention to provide a ring which produces sound and lighting effects when depressed. It is another object of the present invention to provide a ring with sound and light producing means which is inexpensive. According to the present invention, the ring comprises a ring base, the ring base comprising a top open chamber, a top coupling means, a bottom wall, a plurality of through holes through the bottom wall, and a circular band raised from the bottom wall on the outside for fastening to one's finger; a cap having a bottom coupling means loosely coupled to the top coupling means of the ring base, and a light-permeable crown shaped like a gemstone; and a circuit device mounted inside the top open chamber of the ring base, the circuit device comprising a sound producing circuit, a light producing circuit, a battery power supply circuit, and a switch, the switch being switched on to trigger the sound producing circuit and the light producing circuit to produce sound and light for a predetermined length of time each time when the cap is depressed.

DETAILED DESCRIPTION OF THE PREFERRED EMBODIMENT

Figure 1:
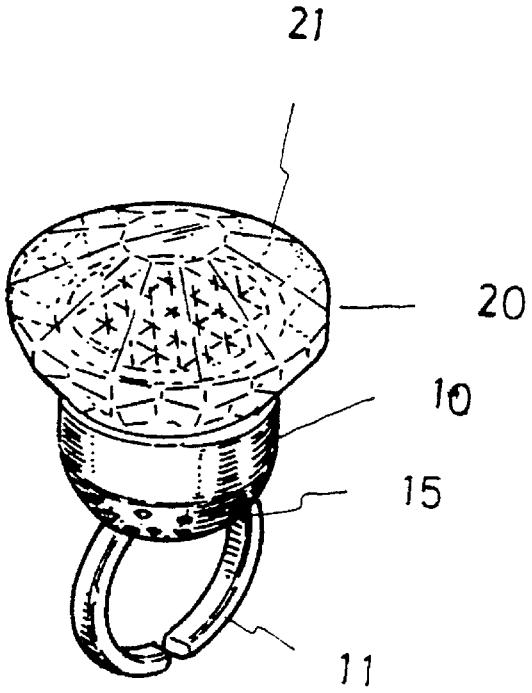
FIG. 1 is an elevational view of a ring according to the present invention.
Figure 2:
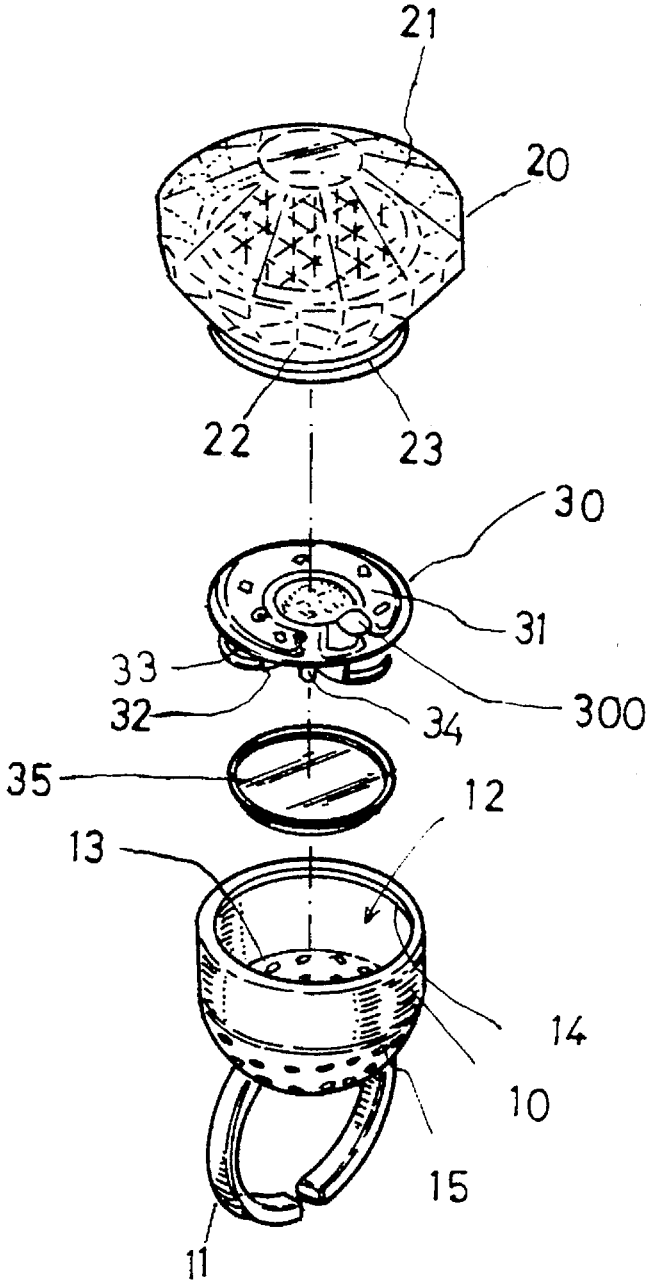
FIG. 2 is an exploded view of the ring shown in FIG. 1.

Referring to FIGS. 1 and 2, a ring in accordance with the present invention is generally comprised of a ring base 10, a cap 20 fastened to the ring base 10, and a circuit device 30 mounted inside the ring base 10 and the cap 20. The ring base 10 and the cap 20 are preferably injection-molded from plastic. The ring base 10 comprises a plurality of through holes 15 through the bottom wall 13 thereof, a circular band 11 raised from the bottom wall 13 on the outside for mounting on one's finger, a top open chamber 12, and an inward top flange 14 of uniform thickness raised around the inner diameter of the top open chamber 12. The cap 20 comprises a crown 21 shaped like a gemstone, a downward shank 22, and an outward bottom flange 23 raised around the periphery of the end of the downward shank 22 for engagement with the inward top flange 14. The circuit device 30 is mounted within the top open chamber 12 of the ring base 10 and stopped below the downward shank 22 of the cap 20, comprising a circuit board 31, a plurality of LEDs (light emitting diodes) 300 mounted on the circuit board 31 at the top side, a plurality of downward flanges 32 raised from the circuit board 31, a battery cell 33 fastened to the space defined within the downward flanges 32, a spring switch 34 suspending from the bottom side of the circuit board 31, and a buzzer 35 connected to the spring switch 34.

Figure 3:
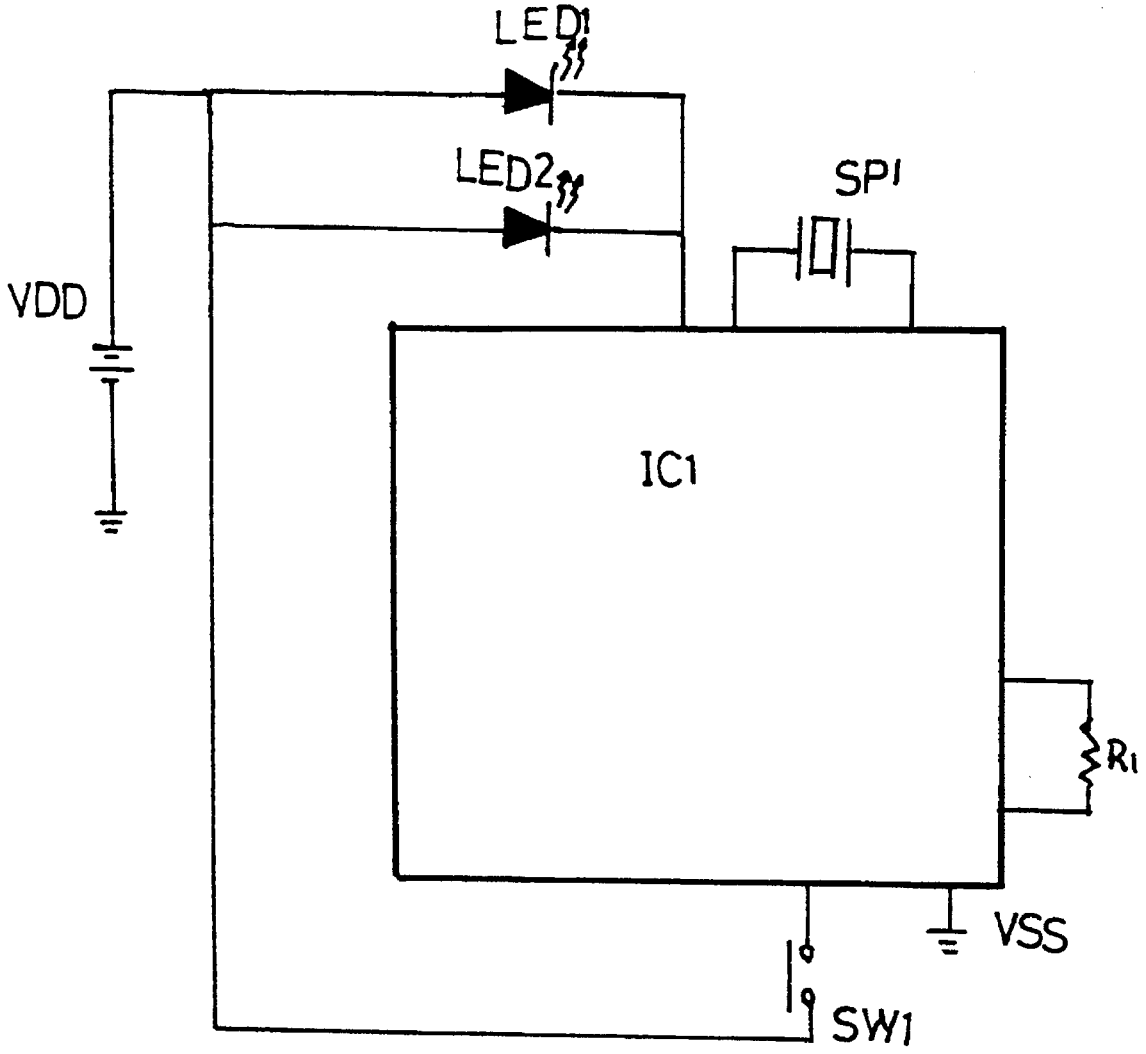
FIG. 3 is a circuit diagram of the single chip circuit according to the present invention.

Referring to FIG. 3, the circuit device 30 is a single chip integrated circuit. As illustrated, the IC1 comprises a variable resistor R1 adapted for the setting of the desired resonance constant. When the switch SW1 (namely, the spring switch 34) is depressed, the IC1 is driven to trigger the LED1 and the LED2 with different oscillation signals, causing them to flash at different time sequences, and at the same time to output a pre-stored music signal through the buzzer 35, permitting sound waves to be driven out of the ring base 10 through the through holes 15. When the music is stopped, the LED1 and the LED2 are turned off.

Figure 4:
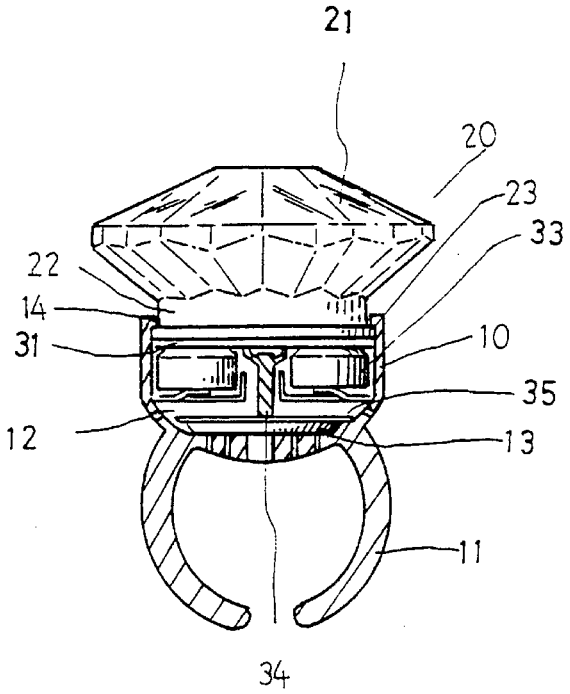
FIG. 4 is a sectional view of the ring shown in FIG. 1 (not operated)
Figure 5:
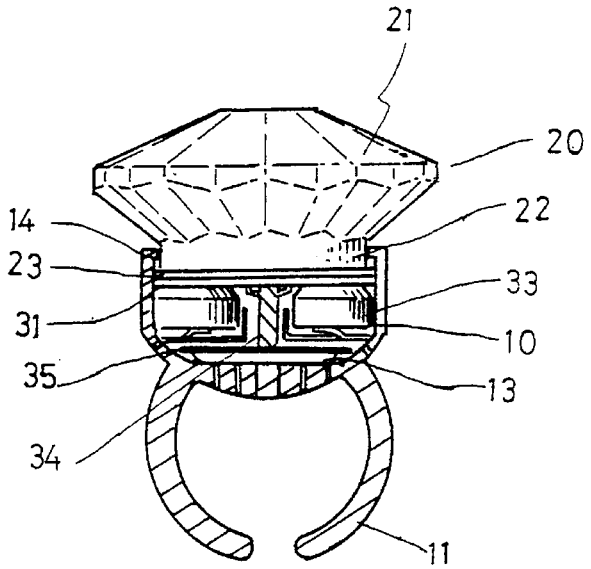
FIG. 5 is another sectional view of the ring shown in FIG. 1, showing the circuit triggered.

Referring to FIGS. 4 and 5, the cap 20 is loosely coupled to the ring base 10, and the circuit is off (see FIG. 4). When the cap 20 is depressed and released, the spring switch 34 is forced to switch on the circuit, causing the LEDs 300 to produce a lighting effect and the buzzer 35 to produce a sound effect. After a predetermined length of time, the circuit device 30 automatically turns off the LEDs 300 and the buzzer 35. When the LEDs 300 are turned on, the crown 21 refracts the light of the LEDs 300 in different directions, and therefore a fantastic lighting effect is produced.

While only one embodiment of the present invention has been shown and described, it will be understood that various modifications and changes could be made without departing from the spirit and scope of the invention disclosed.

What the invention claimed is:

1. A ring comprising:

a ring base, said ring base comprising a top open chamber, a top coupling means, a bottom wall, a plurality of through holes through said bottom wall, and a circular band raised from said bottom wall on the outside for fastening to one's finger;

a cap having a bottom coupling means loosely coupled to the top coupling means of said ring base, and a light-permeable crown shaped like a gemstone; and a circuit device mounted inside the top open chamber of said ring base, said circuit device comprising a sound producing circuit, a light producing circuit, a battery power supply circuit, and a switch, said switch being switched on to trigger said sound producing circuit and said light producing circuit to produce sound and light for a predetermined length of time each time when said cap is depressed.

2. The ring of claim 1 wherein said circuit device is a single chip integrated circuit comprising a resonance constant setting means and being programmed with a piece of voice signal data; said light producing circuit of said circuit device comprises a plurality of light emitting diodes controlled by said switch to flash at different time sequences.

3. The ring of claim 1 wherein the top coupling means of said ring base is an inward flange disposed around said top open chamber at a top side; the bottom coupling means of said cap is an outward flange which is forced into the inside of the top open chamber of said ring base and stopped beneath the inward flange of the top coupling means of said ring base.

4. The ring of claim 1 wherein said sound producing circuit is driven to produce a sound effect through a buzzer thereof, said buzzer being disposed inside the top open chamber of said ring base and facing the through holes of the bottom wall of said ring base.

* * * * *